US007082998B2

(12) United States Patent
Zamora et al.

(10) Patent No.: US 7,082,998 B2
(45) Date of Patent: Aug. 1, 2006

(54) SYSTEMS AND METHODS FOR PLACING A BRAIDED, TUBULAR SLEEVE IN A WELL BORE

(75) Inventors: Frank Zamora, Duncan, OK (US); B. Raghava Reddy, Duncan, OK (US); Mark D. Kalman, Katy, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 169 days.

(21) Appl. No.: 10/630,083

(22) Filed: Jul. 30, 2003

(65) Prior Publication Data

US 2005/0023002 A1 Feb. 3, 2005

(51) Int. Cl.
*E21B 29/00* (2006.01)
*E21B 17/02* (2006.01)
*F16L 11/02* (2006.01)

(52) U.S. Cl. ..... 166/384; 166/236; 166/242.2; 166/277; 166/380; 138/123

(58) Field of Classification Search ..... 166/378, 166/380, 381, 384, 277, 57, 59, 60, 228, 166/230, 236, 242.1, 242.2, 227; 138/98, 138/104, 125, 123
See application file for complete search history.

(56) References Cited

U.S. PATENT DOCUMENTS

| | | | | |
|---|---|---|---|---|
| 3,028,915 A | | 4/1962 | Jennings | 166/46 |
| 3,070,178 A | | 12/1962 | Graham et al. | 175/17 |
| 3,111,991 A | | 11/1963 | O'Neal | 166/207 |
| 3,354,955 A | | 11/1967 | Berry | 166/14 |
| 3,358,769 A | | 12/1967 | Berry | 166/207 |
| 3,419,080 A | | 12/1968 | Lebourg | 166/207 |
| 4,770,562 A | | 9/1988 | Muller et al. | 405/154 |
| 4,870,887 A | | 10/1989 | Tresslar et al. | |
| 5,076,871 A | | 12/1991 | Frye et al. | 156/86 |
| 5,201,757 A | * | 4/1993 | Heyn et al. | 606/198 |
| 5,265,648 A | | 11/1993 | Lyon | 138/98 |
| 5,337,823 A | | 8/1994 | Nobileau | 166/277 |
| 5,348,096 A | | 9/1994 | Williams | 166/384 |
| 5,494,106 A | | 2/1996 | Gueguen et al. | 166/277 |
| 5,501,248 A | | 3/1996 | Kiest, Jr. | 138/98 |

(Continued)

FOREIGN PATENT DOCUMENTS

EP 0542584 9/1992

(Continued)

OTHER PUBLICATIONS

Foreign communication from a related counterpart application dated Sep. 30, 2004.

(Continued)

*Primary Examiner*—Jennifer H. Gay
(74) *Attorney, Agent, or Firm*—Craig W. Roddy; Conley, Rose, P.C.

(57) ABSTRACT

Systems and methods for placing a tubular, braided sleeve in a well bore. The sleeve is positioned within an interior of a carrier configured to hold the sleeve in an undeployed position, followed by lowering the carrier into the well bore. The sleeve may be used in conjunction with a curable resin that can be solidified to set the sleeve into a tubular cross section. After securing the sleeve to the well bore, the carrier may be moved away from the bottom of the well bore, deploying the sleeve and extending it along the contour of the well bore. The tubular sleeve may then be subsequently expanded in situ to increase its diameter. The curable resin can then cured to make the sleeve substantially rigid.

42 Claims, 5 Drawing Sheets

U.S. PATENT DOCUMENTS

| | | | | |
|---|---|---|---|---|
| 5,507,346 | A * | 4/1996 | Gano et al. | 166/285 |
| 5,695,008 | A | 12/1997 | Bertet et al. | 166/187 |
| 5,718,288 | A | 2/1998 | Bertet et al. | 166/287 |
| 5,730,188 | A | 3/1998 | Kalman et al. | |
| 5,823,260 | A | 10/1998 | McConnell et al. | 166/230 |
| 5,833,001 | A | 11/1998 | Song et al. | 166/287 |
| 5,901,789 | A | 5/1999 | Donnelly et al. | 166/381 |
| 5,908,049 | A | 6/1999 | Williams et al. | 138/125 |
| 5,913,337 | A | 6/1999 | Williams et al. | |
| 5,964,288 | A | 10/1999 | Leighton et al. | 166/207 |
| 5,971,071 | A | 10/1999 | Mariaggi et al. | 166/295 |
| 6,044,906 | A | 4/2000 | Saltel | 166/187 |
| 6,065,540 | A | 5/2000 | Thomeer et al. | 166/297 |
| 6,089,276 | A | 7/2000 | Miyazaki et al. | 138/98 |
| 6,102,120 | A | 8/2000 | Chen et al. | 166/287 |
| 6,148,865 | A | 11/2000 | Head | |
| 6,148,899 | A | 11/2000 | Cornie et al. | |
| 6,158,507 | A | 12/2000 | Rouse et al. | 166/228 |
| 6,217,975 | B1 | 4/2001 | Daton-Lovett | 428/105 |
| 6,250,193 | B1 | 6/2001 | Head | 87/2 |
| 6,256,938 | B1 | 7/2001 | Daton-Lovett | |
| 6,286,558 | B1 | 9/2001 | Quigley et al. | |
| 6,296,066 | B1 | 10/2001 | Terry et al. | 175/92 |
| 6,343,652 | B1 | 2/2002 | Corre et al. | 166/302 |
| 6,357,485 | B1 | 3/2002 | Quigley et al. | 138/125 |
| 6,363,974 | B1 | 4/2002 | Perez et al. | |
| 6,390,192 | B1 | 5/2002 | Doesburg et al. | 166/230 |
| 6,415,509 | B1 | 7/2002 | Echols et al. | 29/896.62 |
| 6,431,278 | B1 | 8/2002 | Guinot et al. | 166/252.5 |
| 6,446,672 | B1 | 9/2002 | Kalman et al. | |
| 6,454,493 | B1 | 9/2002 | Lohbeck | 405/184.2 |
| 6,629,547 | B1 | 10/2003 | Yamaguchi et al. | 138/129 |
| 6,706,348 | B1 | 3/2004 | Quigley et al. | 428/36.3 |
| 6,722,433 | B1 * | 4/2004 | Brothers et al. | 166/288 |
| 6,742,586 | B1 | 6/2004 | Lauritzen et al. | 166/227 |
| 6,745,841 | B1 | 6/2004 | Simpson | 166/380 |
| 6,775,894 | B1 * | 8/2004 | Hardin | 29/402.09 |
| 6,834,725 | B1 * | 12/2004 | Whanger et al. | 166/384 |
| 2001/0020053 | A1 | 9/2001 | Mariaggi et al. | 523/130 |
| 2003/0015246 | A1 * | 1/2003 | Hardin | 138/97 |
| 2003/0056948 | A1 | 3/2003 | Cameron | 166/206 |
| 2003/0145992 | A1 | 8/2003 | Corre et al. | 166/302 |
| 2004/0035590 | A1 | 2/2004 | Richard | 166/384 |
| 2004/0060695 | A1 | 4/2004 | Castano-Mears et al. | 166/228 |
| 2004/0144535 | A1 * | 7/2004 | Kalman et al. | 166/278 |
| 2004/0153144 | A1 * | 8/2004 | Sequin | 623/2.11 |

FOREIGN PATENT DOCUMENTS

| | | |
|---|---|---|
| EP | 0 698 136 | 8/1998 |
| EP | 0 972 154 | 6/2001 |
| EP | 1 125 965 | 8/2001 |
| FR | 2 780 751 | 7/2000 |
| FR | 2 782 751 | 7/2000 |
| FR | 2 790 534 | 9/2000 |
| GB | 2363683 | 1/2002 |
| WO | 91/18180 | 11/1991 |
| WO | 96/01937 | 1/1996 |
| WO | 96/21083 | 7/1996 |
| WO | 98/45635 | 10/1998 |
| WO | 98/59151 | 12/1998 |
| WO | 99/25951 | 5/1999 |
| WO | 00/53963 | 9/2000 |
| WO | 01/06087 | 1/2001 |
| WO | 01/07756 | 2/2001 |

OTHER PUBLICATIONS

U.S. Appl. No. 10/352,809, filed Jan. 28, 2003, Kalman et al.

* cited by examiner

SYSTEMS AND METHODS FOR PLACING A BRAIDED, TUBULAR SLEEVE IN A WELL BORE

CROSS-REFERENCE TO RELATED APPLICATIONS

The subject matter of the present application is related to U.S. patent application Ser. No. 10/352,809, filed Jan. 28, 2003, now abandoned, and entitled "Post Installation Cured Braided Continuous Composite Tubular", incorporated by reference herein in its entirety.

FIELD OF THE INVENTION

The present invention generally relates to drilling wells that penetrate subterranean formations. More specifically, the invention relates to systems and methods for using a carrier to place a braided, tubular sleeve in a well bore.

BACKGROUND OF THE INVENTION

Natural resources such as gas, oil, and water residing in a subterranean formation can be recovered by drilling well bores through the formation. As described in U.S. patent application Ser. No. 10/352,809, a braided, tubular sleeve can be placed in a well bore for various purposes such as sealing and maintaining the integrity of the well bore and for conveying devices having the ability to transmit power and data signals into the well bore. The sleeve may be impregnated with a curable resin such that it remains flexible until the resin is cured downhole, at which point the sleeve hardens into an impermeable solid. Unfortunately, fluids flowing in the well bore, e.g., drilling fluid, can undesirably wash away this resin such that the sleeve cannot be hardened as desired. Another problem that may be encountered when installing the sleeve is that the sleeve may become damaged by the rough edges of the rock that forms, along the wall of the well bore drilling. Therefore, a need exists to develop a way to install the sleeve without being concerned that it will be damaged or that the curable resin will be washed away.

SUMMARY OF THE INVENTION

In an embodiment, methods of placing a tubular, braided sleeve in a well bore include providing a carrier, configured to hold the sleeve, positioning the sleeve within an interior of the carrier, and moving the carrier into the well bore. The sleeve comprises a plurality of fibers in a braided arrangement and is flexible such that it can be positioned in the carrier in a compact, undeployed position. The sleeve may be used in conjunction with a curable resin that can be solidified to set the sleeve into a tubular cross section. The sleeve may be pre-coated with or immersed in the curable resin before positioning it in the carrier.

Conveyance string such as a drill pipe may be used to lower the carrier into the well bore by attaching the carrier to a lower end of the conveyance string. The tubing may be lowered in the well bore until the carrier is at a desired location in the well bore. At this point, an anchor attached to the base of the sleeve may be, driven into the ground at the bottom of the well bore, thereby securing the sleeve to the well bore. The tubing may then be moved away from the bottom of the well bore, deploying the sleeve and extending it along the contour of the well bore. In this manner, the tubular sleeve becomes positioned at a predetermined location in the well bore.

The tubular sleeve may then be subsequently expanded in situ to increase its diameter. The expansion of the sleeve may be accomplished by, for example, pressurizing a fluid against an interior wall of the sleeve, positioning an inflatable member such as a bladder within the sleeve and inflating the member, or by drawing a mandrel through the inner diameter of the sleeve. The expanded sleeve can then be formed into a rigid conduit through which fluids may pass by curing the resin in contact with the sleeve. The carrier can then be detached from the tubular sleeve and pulled out of the well bore.

In another embodiment, systems for placing a tubular, flexible sleeve in a well bore include a tubular sleeve comprising a plurality of fibers in a braided arrangement and a curable resin in contact with the fibers. The systems further include a carrier configured to hold the tubular sleeve within its interior and sized to fit in the well bore. The tubular sleeve is preferably disposed within and detachably attached to the carrier. The tubular sleeve is flexible and is thus capable of being expanded inside the carrier. The systems may also include a conveyance string attached to the carrier for lowering the carrier into the well bore and an anchor attached to a base of the sleeve for securing the sleeve to the well bore.

DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

Figure 1:
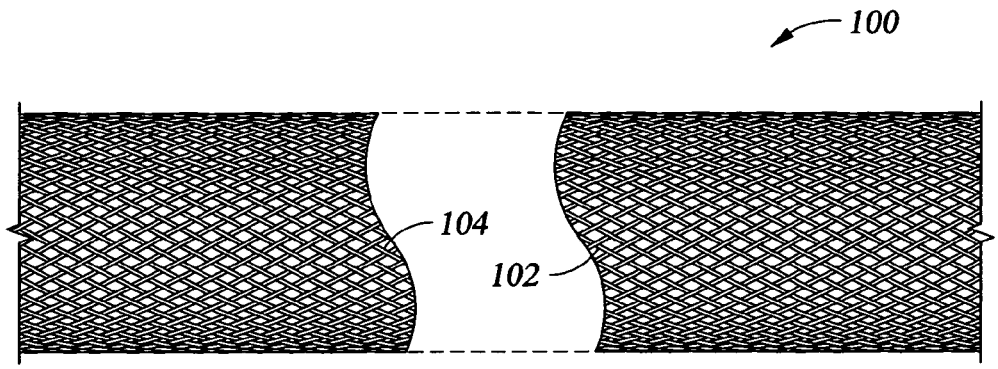
FIG. 1 is a perspective view of a braided sleeve in accordance with a preferred embodiment of the present invention.
Figure 2:
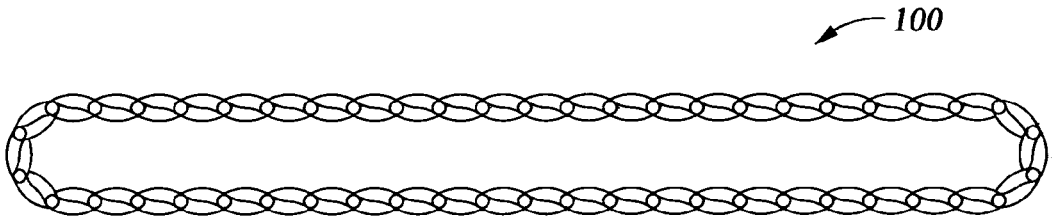
FIGS. 2 and 3 are schematic end views showing the sleeve of FIG. 1 in flat and expanded configurations, respectively.
Figure 3:
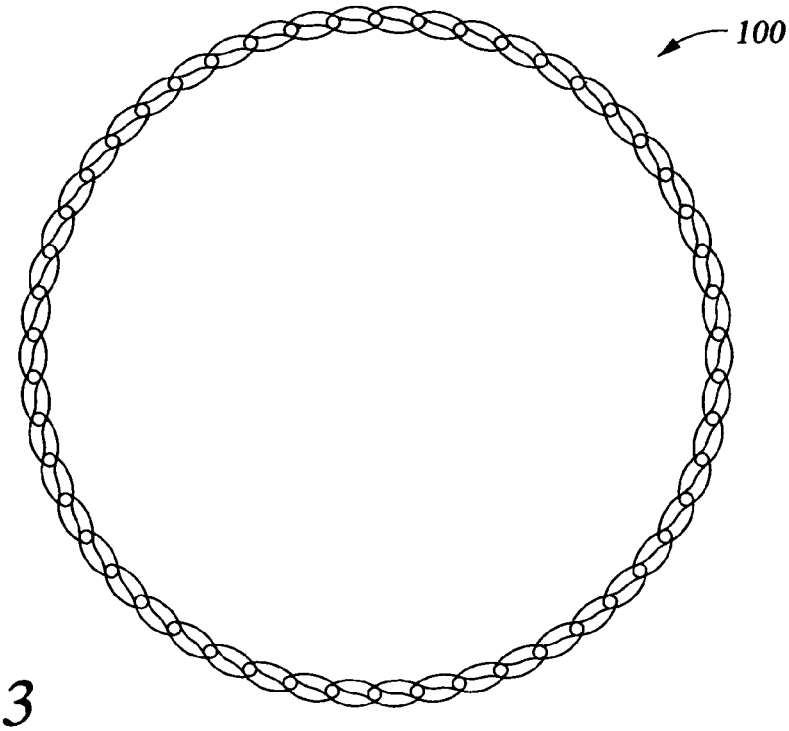
Figure 4:
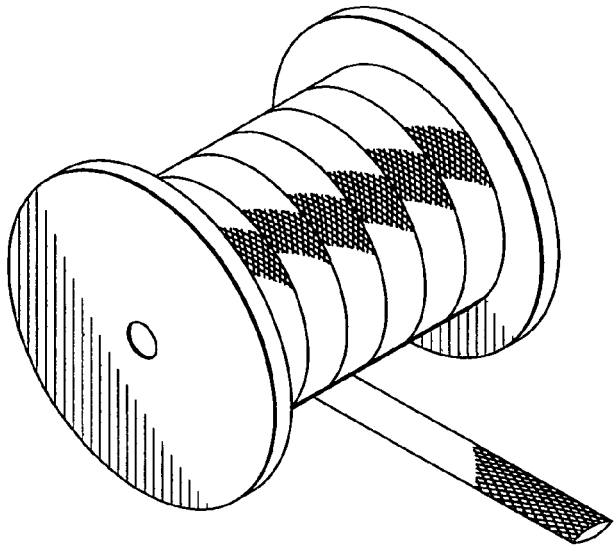
FIG. 4 is a perspective view illustrating the present sleeve stored on a spool.

The present invention refers to applications of a tubular braided sleeve such as the one shown in FIG. 1. The braided sleeve 100 preferably comprises a plurality of fibers 102 and 104 braided or woven to form a continuous tube. As is known in the art fibers 102 are wound in aclockwise direction while fibers 104 are wound in a counterclockwise direction. The fibers can be braided biaxially or triaxially and can be formed of any material known in the art of manufacturing braided, cylindrical objects, including glass, carbon, aramid, nylon, polyester, polypropylene, and the like. Because of the flexibility of the individual filaments, the tubular sleeve can be stored and manipulated between a first, unexpanded position, wherein the tube is substantially flat, and a second, expanded position in which the tube forms a substantially round cylinder. In addition, because the fibers forming the tube can move relative to each other, the tube can be shifted through a range of configurations. At one extreme, the length of the sleeve is at a maximum and the circumference of the tube, whether flattened or rounded, is at a minimum. At the other extreme, the length of the sleeve is at a minimum and the circumference of the sleeve, whether flattened or rounded, is at a maximum. Referring briefly to FIG. 2, the braided sleeve 100 is shown in the flat or unexpanded position. Similarly, FIG. 3 depicts sleeve 100 in an expanded configuration and illustrates how, when so expanded, the sleeve forms a cylindrical, tubular shape. The ability to transport and store the tubular braided sleeve in the flat position allows for handling of the sleeve with significantly reduced space requirements. For example, the flattened sleeve can be conveniently stored on a spool, as illustrated in FIG. 4.

A curable resin (not shown) may be used to harden tubular braided sleeve 100 in the desired expanded shape. The curable resin may include multiple components such as curing agents to facilitate curing. The curable resin may be applied to the fibers of braided sleeve 100 at any point in the process: prior to installation, during installation, or after installation and inflation. The curable resin may be hardened to render the braided sleeve stiff or rigid or to seal the woven fibers of the braided sleeve so that it forms a fluid-impermeable tube.

Some embodiments of the invention may include a local energy source for generating heat to cure the curable agent impregnated in the sleeve. The local source of heat may be a localized exothermic chemical reaction, steam, heat generated by electrical resistance, or any other process typical for curing thermoset resins. The localized exothermic chemical reaction may be the curing of casing cement in the vicinity of the sleeve, or may be any other suitable, strategically positioned chemical reaction. Because well bore temperatures may vary along the length of the tubular braided sleeve, the amount of heat applied to cure the resin may be varied by variation in the composition or location of the energy source. Also, the chemistry of the curable resin and curing agent(s) may be varied along the length of the sleeve to provide a desired heat profile and to account for variation in temperature or other environmental conditions.

The article of the present invention may be shifted from its flattened state to a rounded state using a bladder for inflation of the tubular braided sleeve. If used, the bladder preferably comprises a temperature-resistant polymeric material.

Figure 5:
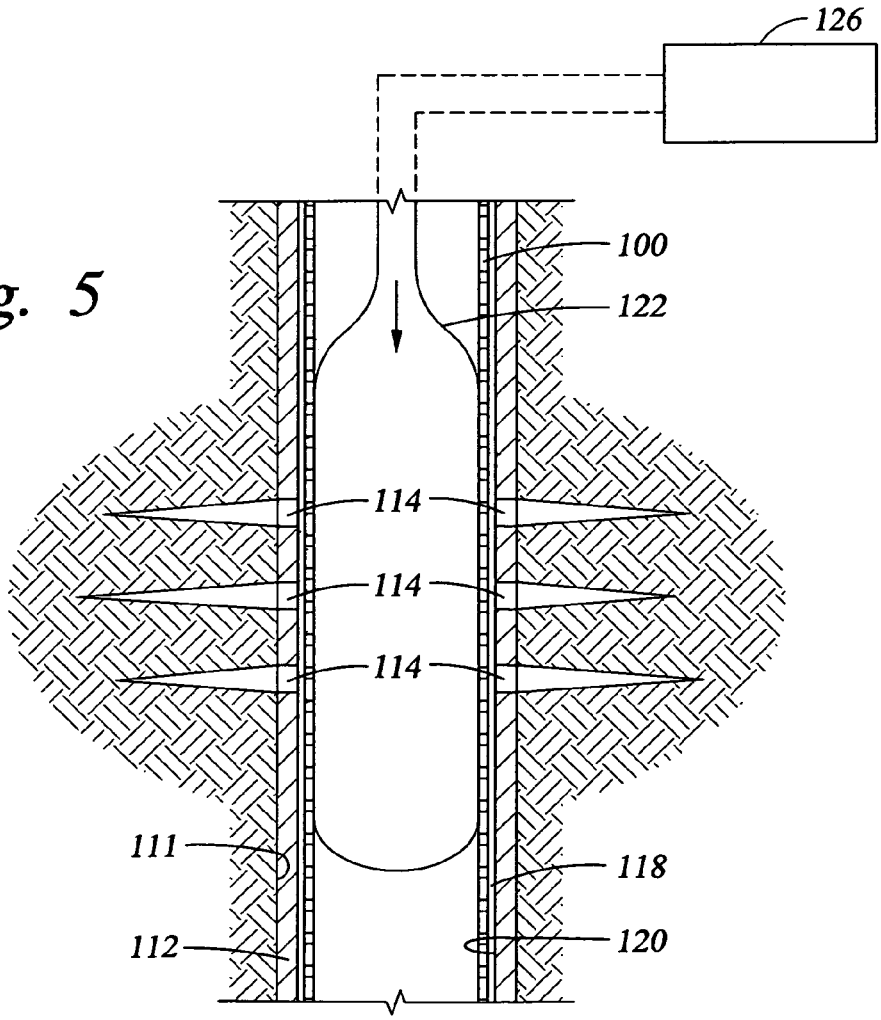
FIG. 5 is a schematic cross-section of a sleeve in accordance with an embodiment of the invention being used to seal a section of previously perforated or damaged casing.

In one embodiment of the application of the present invention, shown in FIG. 5, tubular sleeve 100 is used to seal a section of previously perforated or damaged casing 112. This embodiment is also representative of sealing a lost circulation zone in an open hole. In this embodiment, the objective is to control or eliminate fluid flow and fluid pressure communication between the formation and the well bore 111 in a well where the casing 112 has been perforated so as to form a plurality of perforations 114, or where a well bore has become or is predicted to become unstable. To seal the perforated casing, tubular braided sleeve 100 is installed in the perforated, area, expanded and cured in such a manner that the outer surface 118 of sleeve 100 is in contact with the inside surface 120 of casing 112. In one embodiment, tubular sleeve 100 (including the curable resin and any curing agents) may be provided with an inner inflatable bladder 122 or other interior impermeable layer. Sleeve 100 and bladder 122 are lowered into the well bore to the depth at which it is desired to seal the casing. Sleeve 100 is then inflated by application of a fluid (not shown), pressurized by a device 126 at the surface of the well, acting on interior bladder or impermeable layer 122. Alternatively, sleeve 100 can be expanded outwardly against the casing by drawing a mandrel (not shown) through the sleeve.

The tubular sleeve is then preferably hardened using a localized application of heat. After the resin is cured and the tubular sleeve has hardened, the inflatable bladder (if used) may be withdrawn.

Other applications of the present invention include patching a water-producing zone during the drilling phase of a well bore, placing the sleeve over a low fracture gradient zone to enable drilling to continue without setting a liner or additional casing string. The present invention may also be utilized to stabilize a well bore from collapse and to place across a loss circulation zone. Further, the present invention may be placed in air or foam drilled holes and used as part of a sand control device. Any of the applications of the present invention may be temporary or permanent. Removal after temporary installation can be achieved by drilling out the hardened sleeve.

If desired, multiple sleeves 100 can be utilized so as to provide a thicker finished conduit. Multiple sleeves may be applied by sequential operations of installation of a sleeve, inflation of the sleeve, curing of the resin, and withdrawal of the bladder (if used) or simultaneously by installation of multiple concentric sleeves. As above, each sleeve can be inflated by either a temporary bladder, a permanent fluid tight layer in the sleeve, or other mechanical means such as a mandrel drawn through the inner diameter of the sleeve.

Figure 6:
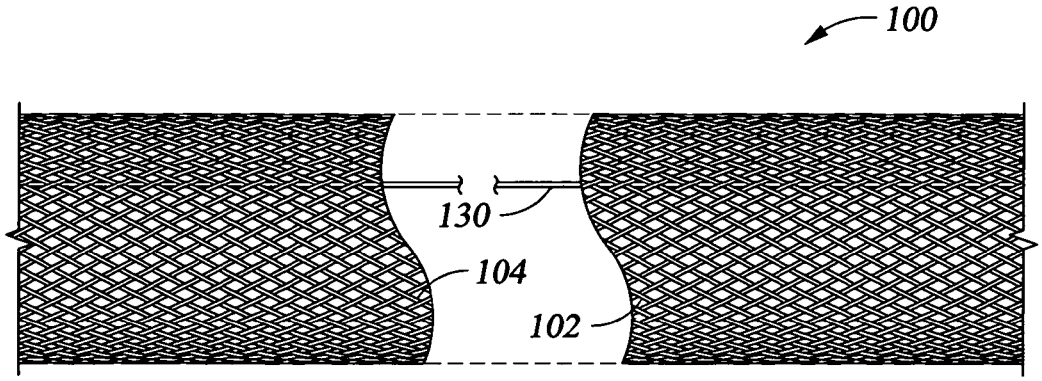
FIG. 6 is an elevation of a braided sleeve including a longitudinal conductor in accordance with an alternative embodiment of the invention.

In a further embodiment, metallic conductors or optical fiber may be incorporated into the sleeve so as to provide a signal and data communication link to downhole equipment and sensors and/or sensors embedded in or affixed to the wall of the cured tubular sleeve. The sleeve provides a robust, protected conduit for conductors and fibers in an otherwise hostile environment. As shown in FIG. 6, a longitudinal conductor 130 comprising a metallic wire or bundle of wires, which can alternatively comprise a optical fiber or bundle of fibers, can be incorporated into the uncured tubular braided sleeve and become set in place when the sleeve is cured. In the embodiment shown in FIG. 6, the conductor 130 runs parallel to the axis of the sleeve. Although not wound helically conductor 130 is preferably woven into the helically wound fibers 102 and 104. Alternatively, the conductor(s) may be woven into the fibers of the sleeve in a helical manner. Connectors (not shown) for extending the conductor or optical fiber can also be incorporated into the ends of the sleeve.

Figure 7:
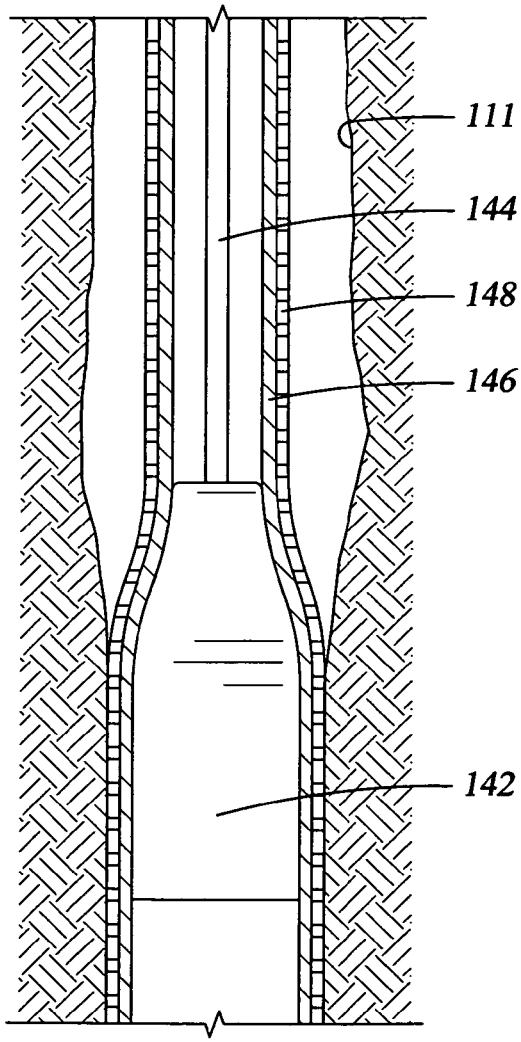
FIG. 7 is a schematic cross-section of a sleeve in accordance with an embodiment of the invention being expanded in conjunction with an expandable casing using a mandrel.

In still another embodiment, implementations of the invention may include applications external to metallic casing or sand screens. In one such application, shown in FIG. 7, the casing comprises a metallic expandable tubular 146, used in well construction for reducing or eliminating diameter transitions, such as in a monobore well. In this application, the sleeve may be run into the well prior to placement of the metallic casing or can be inserted into the well on the outer diameter of the metallic casing. In order to maintain a continuous sleeve, a longitudinal or helical seam may be required that is either stitched or adhered together during installation. The tubular braided sleeve 148 expands as the casing or screen is expanded by the drawing of a mandrel 142 which is pulled toward the surface using a cable or wireline 144. This configuration is particularly useful in combination with embedded metallic conductors or optical fiber for use in conductors because of the difficulty in providing for signal and data communication in monobore or reduced diameter transition wells. Because the structural support provided by the tubular braided sleeve may reduce the forces and stresses on the metallic expandable casing, one advantage of the present invention is to reduce the weight and thickness requirement for the metallic expandable casing or screen thereby decreasing the forces and pressure required to expand the metallic expandable casing or screen as well as the time required to accomplish that expansion. These factors may also allow for a larger diameter change during expansion of the metallic expandable casing or screen. The heat required for curing can be provided by circulating high temperature fluids within the bore of the tubular, by electrical resistance heating of conductors embedded in the composite braid, by an exothermic reaction of casing cement in the vicinity of the sleeve, or by any other practical means.

In another embodiment of the invention, for use as production tubing or casing in deep wells, an internal cable (not shown) is placed within the tubular braid in order to support the tension loading during installation. The internal cable may be metallic, high performance polymer, or other material capable of bearing high longitudinal tensile stress. The internal cable is preferably incorporated into the braid to distribute the load due to the weight of the sleeve to the cable and may optionally also support the weight of a device at the bottom of the sleeve, such as a bottom hole assembly. Similarly, a longitudinal cable may be utilized to support the tubular braided sleeve during installation. Such a cable may be external or internal to the sleeve and may be removed after installation and curing of the resin.

Another use for the present invention is as a means for installing and fixing in place a composite screen for the purposes of particulate control, more specifically for confining sand to the formation while allowing the production fluid to flow out of the formation into the well bore. Current sand screens are manufactured as multiple layers of corrosion resistant steel expanded metal and wire screens. A composite braided sleeve, or multiple braided sleeves, can be employed as a sand screen. A tubular braided sleeve can also be used as a protective shroud or layer over conventional metallic screens. The composite braided tubular sleeve could also incorporate metallic and/or fiber optic conductors and/or sensors into the fabric to make a smart sand screen.

The braiding configuration can be easily optimized for the necessary mesh size as required to minimize particulate flow into the well bore. It may also be possible to provide an adjustable mesh size by axially compressing or expanding the mesh to change the mesh size to allow for screen cleaning by backflushing the screen. The braided sleeve impregnated with a resin can be used as a means for providing a composite screen that can be inflated either mechanically or hydraulically (using a bladder inside to expand). Once the sleeve is in contact with the formation face and allowed to set, it would act as a sand control device that conforms to the well bore.

During drilling operations, a patch of braided sleeve can be used to cover a water-producing zone or a low fracture gradient zone or can be placed within a horizontal well bore to stabilize the well bore against collapse. The braided sleeve can be placed around the drill string and expanded at the pre-specified location.

Figures 8, 9, 10, 11:
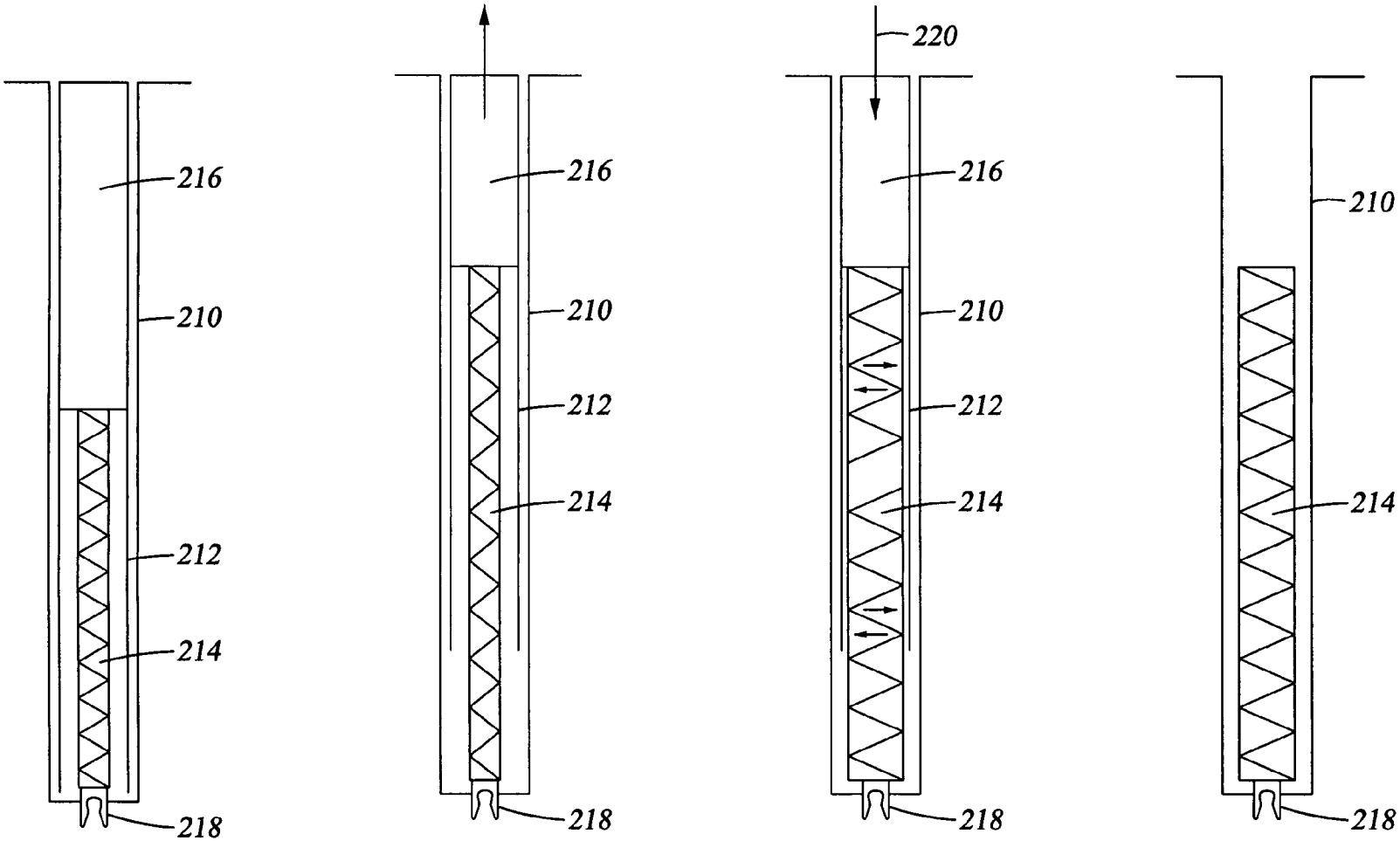
FIG. 8 is a schematic cross-section of a braided sleeve being positioned in a well bore by a carrier within which the sleeve is disposed in a folded state in accordance with an embodiment of the invention, wherein an anchor attached to the sleeve secures the sleeve to the bottom of the well bore.
FIG. 9 is a schematic cross-section of the sleeve and the carrier shown in FIG. 8, wherein the carrier is moved away from the bottom of the well bore to cause the sleeve to unfold and expand along the length of the well bore.
FIG. 10 is a schematic cross-section of the sleeve and the carrier shown in FIG. 9, wherein the diameter of the sleeve is expanded by pumping a curing agent into the sleeve, thereby causing a curable resin in contact with the sleeve to harden in situ.
FIG. 11 is a schematic cross-section of the sleeve shown in FIG. 9, wherein the carrier has been detached from the sleeve and removed from the well bore.
Figure 12:
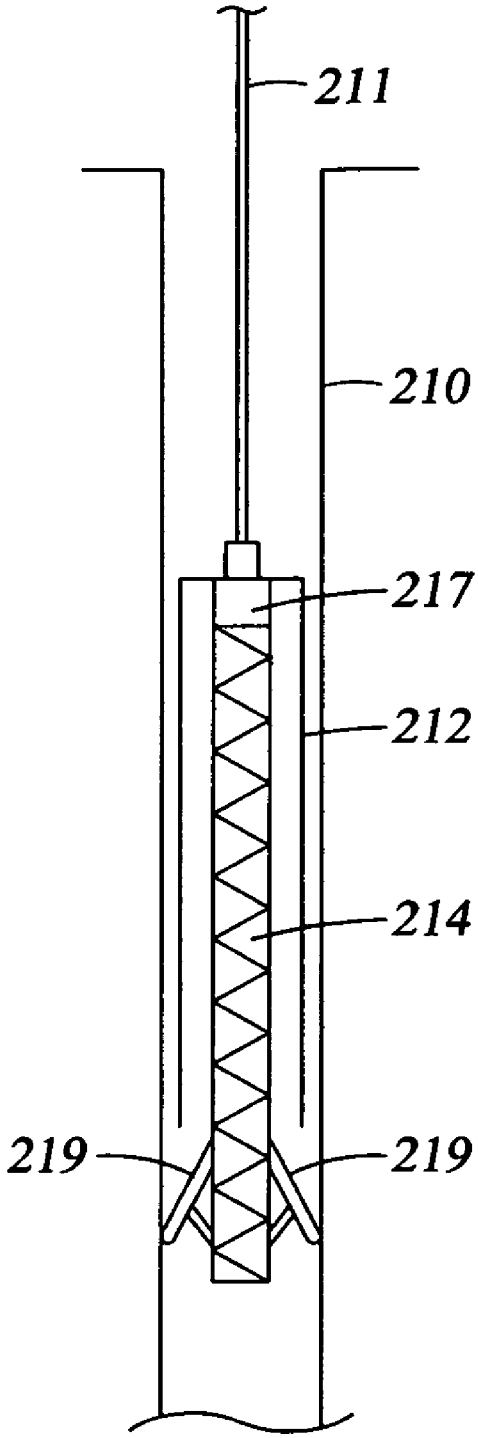
FIG. 12 is a schematic cross-section of an alternative embodiment of a sleeve being positioned in the wellbore by a carrier.

In yet another embodiment, the previously described tubular, braided sleeve may be easily installed in a well bore using systems that include a carrier (or sub) configured to hold the sleeve. FIG. 8 depicts such a system being used to place a braided sleeve 214 in a well bore 210. The sleeve 214 is disposed within an interior of a carrier 212, which surrounds the length of sleeve 214. Further, an upper end of carrier 212 is attached to a lower end of a conveyance string 216, e.g., a drillpipe or tubing, for lowering carrier 212 into well bore 210. Alternatively, carrier 212 may be attached to other types of conveyance strings, e.g., a wireline 211 as shown in FIG. 12, to lower it downhole. In addition, an anchor 218 may be detachably attached with, e.g., shear pins, to the base of sleeve 214 for securing the sleeve to the bottom of well bore 210. Alternatively, extending arms attached to the base of sleeve 214 can be utilized to anchor sleeve 214 to the formation wall (not shown). The extending arms are similar to those currently used on caliber tools. The extending arms may be maneuvered to drive the anchors into the sidewall of the formation, allowing sleeve 214 to be positioned mid-way in well bore 210. Although not shown, the system may also include an inflatable member inside of sleeve 214 for expanding a diameter of sleeve 214 when desired.

As described previously, sleeve 214 is substantially flexible and is thus capable of being expanded both in a vertical direction and in a horizontal direction. Due to the flexibility of sleeve 214, it may be initially placed in carrier 212 in a folded position. Sleeve 214 may be impregnated, saturated, or coated with a curable resin that is capable of being cured to a hard, impermeable solid. Examples of suitable curable resins include, but are not limited to: acid curable resins such as melamine-formaldehyde, phenolic resin, and furfuryl alcohol resin; epoxide resins that may be cured by being contacted with metal oxide/amine activators; partially polymerized resins such as polyurethanes, polyamides, and latexes that may be cured by heating; and monomers such as methylmethacrylate that may be cured by azo or peroxide initiators and heat.

In order for the resin formulation to cure on the tubular surface of sleeve 214 and not be extracted by the well bore fluid during the expansion process, the resin formulation may be partially cured first without sacrificing flexibility prior to inserting sleeve 214 in carrier 212. The partial curing can be achieved by drying the treated sleeve 214 in an oven or a flowing stream of air. The partial curing results in a flexible dry film that makes sleeve 214 impermeable to fluid flow but still permeable to curing agents such as acids and amines that will further cure the formulation to afford enhanced rigidity to the sleeve 214 upon placement. This two stage curing process can be accomplished by using blends of different materials such as film forming materials, e.g., latexes, in combination with thermosetting resins, e.g., phenolics, melamine formaldehyde or urea formaldehyde derivatives, furfuryl alcohol derivatives, partially pre-polymerized systems such as polyester-styrene formulations, and the like.

Additionally, curing agents capable of enhancing bonding of the resin formulation to the fibers of tubular sleeve 214 such as silane coupling agents, e.g., aminosilanes, can be added to the formulation. Moreover, polymers capable of particle suspensions, enhanced bonding to the sandstone type of formations, and participation in cross-linking reactions with resins can also be added to the formulation. Examples of such polymer systems include hydroxyethylcellulose, polysaccharide gums, cationic starches, polyvinylalcohol, chitosan, alginic acid, and the like. Chemicals capable of providing stiffness to the cured formulation upon expansion may also be included in the formulation. Examples of such chemicals include silica, alumina, spherical beads, fibers, and the like. Stiffness enhancing materials may also be used in the dissolved form during the first stage treatment but precipitate as insoluble particles upon curing in a low pH fluid during the expansion stage. For example, sodium silicate which is soluble in water may be added to the first stage treatment mixture and then made to form silica particles during the second stage expansion of the sleeve 214 with an acidic fluid. When porosity in the expanded tubular is needed as in the case of controlling particle flow from the formation (e.g., sand control), materials such as acid soluble minerals, e.g., calcium carbonate, of a desired particle size may be included in the formulation initially. Such acid soluble minerals will be dissolved by the acid used to cure sleeve 214 after expansion, leaving behind pores of defined sizes that can filter out the particles from the formation. Resin formulations suitable for rendering braided fiber networks impermeable to fluids are described in various references, for example, U.S. Pat. Nos. 6,171,984, 6,358,609, 5,847,033, and 4,564,552.

Carrier 212 is sized to fit inside of well bore 210 and is substantially cylindrical in shape. Carrier 212 may be composed of a material suitable for protecting sleeve 214 from damage as it passes through well bore 210. For example, carrier 212 may be composed of materials that are commonly used in casings for cementing operations, such as steel. The upper end of carrier 212 provides a way to connect carrier 212 to a conveyance string, e.g., tubing, wire line, etc. For example, the upper end of carrier 212 and the lower end of conveyance string 216 may be threaded to mate with each other, or an adhesive or glue may be employed to hold the two together. Also, the upper end of carrier 212 may be detachably attached to the top of sleeve 214 by a release mechanism 217 as shown in FIG. 12. An example of a suitable release mechanism may utilize a sliding sleeve mechanism and a ball activated or J slot activated mechanism, all of which are known in the art. For example, sleeve 214 may be attached to carrier 212 with shear pins that detach from sleeve 214 when the ball of the ball activated mechanism drops, causing the pins to shear under pressure.

Anchor 218 includes a substantially pointed end or other attachment/securing means that can be driven into the ground at the bottom of well bore 210. Anchor 218 may be composed of any material that can be driven into the ground without breaking or collapsing. For example, anchor 218 may be composed of aluminum, steel, a composite material, a relatively hard plastic, or combinations thereof. Anchor 218 may be detachably attached to the bottom of sleeve 214 by a release mechanism (not shown) such as a sliding sleeve mechanism and a ball activated or J slot activated mechanism. For example, anchor 218 may be attached to shear pins that engage the wall of sleeve 214. The shear pins detach from sleeve 214 when the ball of the ball activated mechanism drops.

In still another embodiment, methods are provided for forming and using the system described above to position sleeve 214 at a predetermined location in well bore 210. It is to be understood that while well bore 210 is oriented in a vertical direction, it may also be oriented in a horizontal direction. The methods include first pre-coating or impregnating sleeve 214 with a curable resin. Alternatively, sleeve 214 may be impregnated/coated while positioned within carrier 212. As depicted in FIG. 8, sleeve 214 may then be placed within and detachably attached to carrier 212 and anchor 218 using the release mechanisms described above. Sleeve 214 may be initially placed in carrier 212 in a folded state.

The conveyance string 216 attached to the top of carrier 212 may then be lowered into well bore 210 until carrier 212 and sleeve 214 are at a desired location in well bore 210. As sleeve 214 is moved through well bore 210, carrier 212 protects it from being damaged by rough edges that may be present along the sides of the well bore. Carrier 212 also protects the curable resin on sleeve 214 from being washed away by formation fluids that could be flowing in well bore 210. Thereafter, sleeve 214 may be attached to the bottom of well bore 210 by applying a downward force to anchor 218 or activating a mechanism that drives anchor 218 into the ground. Alternatively as shown in FIG. 12, the sleeve may be attached mid-way in well bore 210 by pulling up and releasing extending arms 219 attached to the base of sleeve 214 that are similar to technology used on caliber tools. In this manner, the extending arms are opened up. The extending arms may then be pushed downward to anchor them into a sidewall of the formation.

Next, as illustrated in FIG. 9, conveyance string 216 may be moved back toward the top of well bore 210, thereby raising carrier 212. As a result, the top of sleeve 214 is pulled upward while the base of sleeve 214 remains secured to the bottom of well bore 210. Sleeve 214 is thus at least partially unfolded and extended along the length of well bore 210. The distance by which conveyance string 216 is moved is sufficient to position the length of sleeve 214 at a predetermined location in well bore 210.

As depicted in FIG. 10, the diameter of sleeve 214 is subsequently expanded such that sleeve 214 becomes tubular in cross section. The expansion of sleeve 214 may be accomplished by pumping a fluid through conveyance string 216 to the inside of sleeve 214, as indicated by arrow 220. Sleeve 214 is preferably impermeable to fluid such that it may be expanded by pressurizing the fluid against an interior wall of sleeve 214. Examples of suitable fluids that may be used to expand sleeve 214 include, but are not limited to, a curable resin, a curing agent or catalyst, a drilling fluid, and combinations thereof. As such, sleeve 214 may be coated with the curable resin concurrent with the expansion of sleeve 214, or it may be coated before or after performing the expansion. Alternatively, sleeve 214 may be expanded by moving a mandrel through the sleeve or by positioning an inflatable member such as a bladder within sleeve 214 and inflating the member. The inflatable member may have been pre-inserted in sleeve 214 before passing sleeve 214 into well bore 210, or it may be inserted later when desirable to expand sleeve 214.

In addition, the wall of flexible sleeve 214 may also be made rigid by causing the curable resin in contact with sleeve 214 to cure. One way that the curable resin may be cured is by injecting a curing agent into tubular 216. A curing agent is herein defined as a material having the ability to cause the curable resin to cure and form an impermeable solid. This same curing agent may also serve as the fluid employed to expand sleeve 214 in the manner described above. The particular curing agent used depends on the type of resin in contact with sleeve 214. For example, if the resin is an acid curable resin, the curing agent may be an acid. However, if the resin is an epoxide resin, the curing agent may comprise metal oxides, amines, and combinations thereof. On the other hand, if the resin is a heat curable resin, sleeve 214 may be heated in the manner described previously.

After sleeve 214 has become substantially rigid and inflexible, sleeve 214 no longer needs conveyance string 216 and carrier 212 to hold it in place. Thus, sleeve 214 may be released from carrier 212, followed by lifting conveyance string 216 and carrier 212 out of well bore 210. If desired, carrier 212 may be reloaded with another sleeve and reused to position the sleeve in a well bore. The resulting configuration of sleeve 214 after the removal of carrier 212 is shown in FIG. 11. Sleeve 214 may extend lengthwise along the wall of well bore 210 for, e.g., several hundreds of feet. If desired, well bore 210 may be extended to a depth below sleeve 214 by running a drill bit down through the interior of sleeve 214 and continuing to drill through anchor 218 and into the ground at the base of well bore 210. The presence of sleeve 214 helps maintain the integrity of well bore 210 during the drilling so as to ensure that well bore 210 does not collapse. As described previously, it also serves to isolate the subterranean zones penetrated by well bore 210, to prevent loss circulation of the drilling fluid, and to inhibit sand from undesirably migrating into well bore 210.

EXAMPLES

The invention having been generally described, the following examples are given as particular embodiments of the invention and to demonstrate the practice and advantages thereof. It is understood that the examples are given by way of illustration and are not intended to limit the specification or the claims to follow in any manner.

Example 1

Several samples of a 3" long and 1" diameter fiber glass biaxial tubular fabric obtained from A&P Technology of Cincinnati, Ohio was soaked in a variety of solutions for 3 to 5 minutes as shown in Table 1. All the solutions were made by adding the amounts indicated in Table 1 to a 0.70 milliliter (ml) solution of FWCA hydroxyethylcellulose (HEC) available from Halliburton Co. The viscosity of each solution was 710 centipoise (# 1 Spindle @ 6 revolutions per minute) using a Brookfield viscometer.

After soaking, each sample was allowed to drain in a beaker in open air. As presented in Table 1, the flexibility of the fibers and the coverage of open network in the braided fabric of each sample were judged relative to each other. The most desirable solution formulations were determined to be the ones that covered the tubular fabric in a thick and homogeneous manner during the treatment stage and left a good film over the entire fabric while retaining the flexibility of the fabric upon drying. Samples 3, 5, 7, 8, and 9 were thus the most desirable solution formulations, with sample 9 being the best.

TABLE 1

| Sample | HEC solution | Latex 1[1] | Latex 2[2] | Sodium silicate solution[3] | Calcium sulfate hemihydrate | Calcium carbonate[4] | Resin[5] | Comments |
|---|---|---|---|---|---|---|---|---|
| 1 | 20 ml | 20 ml | — | 8 ml | — | — | — | Very stiff fibers; open mesh area not filled uniformly |
| 2 | 20 ml | — | 20 ml | 8 ml | — | — | — | Stiff fibers; mesh area fairly well covered with film |
| 3 | 20 ml | 20 ml | — | — | 4 ml (80% solid) | — | — | Flexible fibers; mesh area fairly well covered with film |
| 4 | 20 ml | 20 ml | — | — | — | 3 g | — | Fairly stiff fibers; mesh area fairly well covered with film |
| 5 | 20 ml | 20 ml | — | 8 ml | — | — | 2 ml | Flexible fibers; mesh area completely covered |
| 6 | 20 ml | — | 20 ml | 8 ml | — | — | 2 ml | Flexible fibers; mesh area not covered |
| 7 | 20 ml | 20 ml | — | — | — | — | 8 ml | Flexible fibers, mesh area fairly covered with film |
| 8[6] | 20 ml | 20 ml | — | — | — | — | 8 ml | Flexible fibers; mesh area with good coverage with film |

TABLE 1-continued

| Sample | HEC solution | Latex 1[1] | Latex 2[2] | Sodium silicate solution[3] | Calcium sulfate hemihydrate | Calcium carbonate[4] | Resin[5] | Comments |
|---|---|---|---|---|---|---|---|---|
| 9[7] | 20 ml | 20 ml | — | — | — | — | 8 ml | Flexible fibers; excellent coverage of mesh area by film |

[1]Latex 1 is an experimental latex obtained from Dow Reichhold Corporation of Charlotte, North Carolina and is based on an ethylene vinylacetate copolymer system.
[2]Latex 2 is available from Halliburton Co. under trade name LATEX 2000 and is based on a styrene butadiene copolymer system.
[3]FLOCHECK A sodium silicate solution available from Halliburton Co. was used.
[4]BARACARB 150 calcium carbonate available from Halliburton Co. was used; the particle size was 150 microns.
[5]RESIMENE 745 hexamethoxymethylene melamine resin available from Solutia Corporation of St. Louis, Missouri was used.
[6]The tubular fabric was pre-soaked in a solution of BC 140 organic tetraborate salt solution available from Halliburton Co. prior to soaking in the treatment solution.
[7]The tubular fabric was soaked in a 5 weight % sodium borate solution prior to soaking in the treatment solution.

Example 2

The treated, dried glass fiber tubular samples 8 and 9 were heated at 160° F. in a 10 weight % ammonium chloride solution for 24 hours to achieve curing of the melamine resin present in the formulation. The samples were taken out and examined for enhanced stiffness of the fabric. While both tubular samples exhibited increased stiffness, sample 8 was slightly stiffer than sample 9.

While the preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claims.

Accordingly, the scope of protection is not limited by the description set out above, but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of placing a tubular sleeve in a well bore, the method comprising:

a) providing a carrier configured to hold a tubular sleeve comprising a plurality of fibers in a braided arrangement;

b) positioning the tubular sleeve within an interior of the carrier;

c) moving the carrier into the well bore; and d) releasing the sleeve from the carrier and removing the carrier from the well bore.

2. The method of claim 1 wherein an upper end of the carrier is attached to a lower end of a conveyance string.

3. The method of claim 2 wherein the conveyance string is tubing.

4. The method of claim 2 wherein the conveyance string is wireline.

5. The method of claim 1, further comprising positioning the carrier proximate a bottom of the well bore by lowering the carrier in the well bore.

6. The method of claim 5 wherein an anchor is attached to a base of the sleeve.

7. The method of claim 6, further comprising securing the anchor to the ground at the bottom of the well bore.

8. The method of claim 1, further comprising positioning the carrier between a lower end of the well bore and an upper end of the well bore.

9. The method of claim 8 wherein extending arms are attached to a base of the sleeve.

10. The method of claim 9, further comprising securing the extending arms to a sidewall of the well bore.

11. The method of claim 1 wherein the sleeve is in a folded position within the interior of the carrier.

12. The method of claim 11, further comprising moving the carrier toward a top of the well bore such that the sleeve at least partially unfolds, thereby positioning the sleeve at a predetermined location.

13. The method of claim 1, further comprising expanding the sleeve.

14. The method of claim 13 wherein said expanding comprises pressurizing a fluid against an interior wall of the sleeve.

15. The method of claim 14 wherein the fluid comprises at least one of a curable resin, a curing agent, or a drilling fluid.

16. The method of claim 13 wherein said expanding comprises positioning an inflatable member within the sleeve and inflating the member.

17. The method of claim 13 wherein said expanding comprises moving a mandrel through the sleeve.

18. The method of claim 1, further comprising treating the sleeve with a curable resin before step (b).

19. The method of claim 1, further comprising treating the sleeve with a curable resin after step (b).

20. The method of claim 18 wherein the curable resin comprise at least one of an acid curable resin, an epoxide resin, a partially polymerized resin capable of being cured by heating, and monomers capable of being cured by azo or peroxide initiators and heating.

21. The method of claim 18, further comprising partially curing the curable resin before step (b).

22. The method of claim 21, further comprising curing the curable resin after step (b).

23. The method of claim 22 wherein said substantially curing comprises injecting a curing agent into the sleeve.

24. The method of claim 22 wherein said substantially curing comprises heating the sleeve.

25. The method of claim 24, further comprising reloading the carrier with another sleeve.

26. The method of claim 1, further comprising passing a drill bit through the sleeve and drilling the well bore a distance below the sleeve.

27. The method of claim 21 wherein said curing the resin causes the sleeve to become substantially impermeable.

28. A system for placing a tubular sleeve in a well bore, the system comprising:

a tubular sleeve comprising a plurality of fibers in a braided arrangement; and a carrier configured to hold the tubular sleeve within its interior, wherein upon placement of the tubular sleeve in the wellbore, the sleeve is detachable from the carrier and the carrier is removable from the wellbore.

29. The system of claim 28 wherein the fibers comprise at least one of glass, aramid, nylon, carbon, polyester, and polypropylene.

30. The system of claim 28 wherein the carrier comprises steel.

31. The system of claim 28, further comprising a conveyance string attached to the carrier for lowering the carrier into the well bore.

32. The system of claim 28, further comprising at least one anchor or extending arm attached to the sleeve for securing the sleeve to the well bore.

33. The system of claim 32 wherein the at least one anchor or extending arm comprises at least one of aluminum, steel, a composite material, and a plastic.

34. The system of claim 28 wherein the sleeve is in an undeployed state within the interior of the carrier.

35. The system of claim 34 wherein the sleeve is folded.

36. The system of claim 34 wherein the sleeve is substantially flexible and is configured for expansion upon deployment.

37. The system of claim 28, further comprising an inflatable member disposed inside the sleeve for expanding the sleeve.

38. The system of claim 28, further comprising a curable resin disposed on the sleeve.

39. The system of claim 38 wherein the curable resin comprises at least one of an acid curable resin, an epoxide resin, a partially polymerized resin capable of being cured by heating, and monomers capable of being cured by azo or peroxide initiators and heating.

40. The system of claim 28 wherein the carrier is sized to fit within a well bore.

41. The system of claim 28 wherein the carrier is substantially cylindrical in shape.

42. The system of claim 28 wherein the carrier comprises a release mechanism for releasing the sleeve.

* * * * *